United States Patent [19]

Switall

[11] Patent Number: 4,637,341

[45] Date of Patent: Jan. 20, 1987

[54] APPARATUS FOR APPLYING SILICONE EMULSION TO A PAPER WEB

[75] Inventor: Thomas G. Switall, Wheeling, Ill.

[73] Assignee: Rayco Graphic Manufacturing, Inc., Wheeling, Ill.

[21] Appl. No.: 770,104

[22] Filed: Aug. 28, 1985

[51] Int. Cl.[4] ..... B05C 11/10; B05C 1/08

[52] U.S. Cl. ..... 118/694; 118/223

[58] Field of Search ..... 222/14, 57; 137/113; 118/694, 46, 223

[56] References Cited

U.S. PATENT DOCUMENTS 2,953,476 9/1960 Armstrong ..... 118/694 X 4,247,018 1/1981 Credle ..... 137/113 X

*Primary Examiner*—Evan K. Lawrence

*Attorney, Agent, or Firm*—Lee, Smith & Zickert

[57] ABSTRACT

A silicone applicator and method are disclosed which apply a controlled concentration of an aqueous silicone emulsion to a paper web as the web is moving through a printing press. The applicator comprises a silicone concentrate supply tank, a water supply, and a mixing tank for mixing the slicone concentrate with the water to form an aqueous silicone emulsion of desired concentration. A silicone holding tray holds a supply of silicone emulsion, and a roller picks up the silicone emulsion from the holding tray and applies it to the paper web. A first transfer device transfers to the mixing tank metered quantities of the silicone concentrate from the supply tank, and water from the water supply. Water is charged to the mixing tank when a sensor in the tank senses that the level in the tank is below a predetermined lower limit. The charging is discontinued when the level reaches a predetermined high value as detected by another sensor. An adjustable control controls the amount of silicone concentrate transferred by the first transfer device to the mixing tank, so that the concentration of the aqueous emulsion mixed in the mixing tank may be controlled. A second transfer device delivers controlled concentrations of the mixed silicone emulsion from the mixing tank to the holding tray.

5 Claims, 1 Drawing Figure

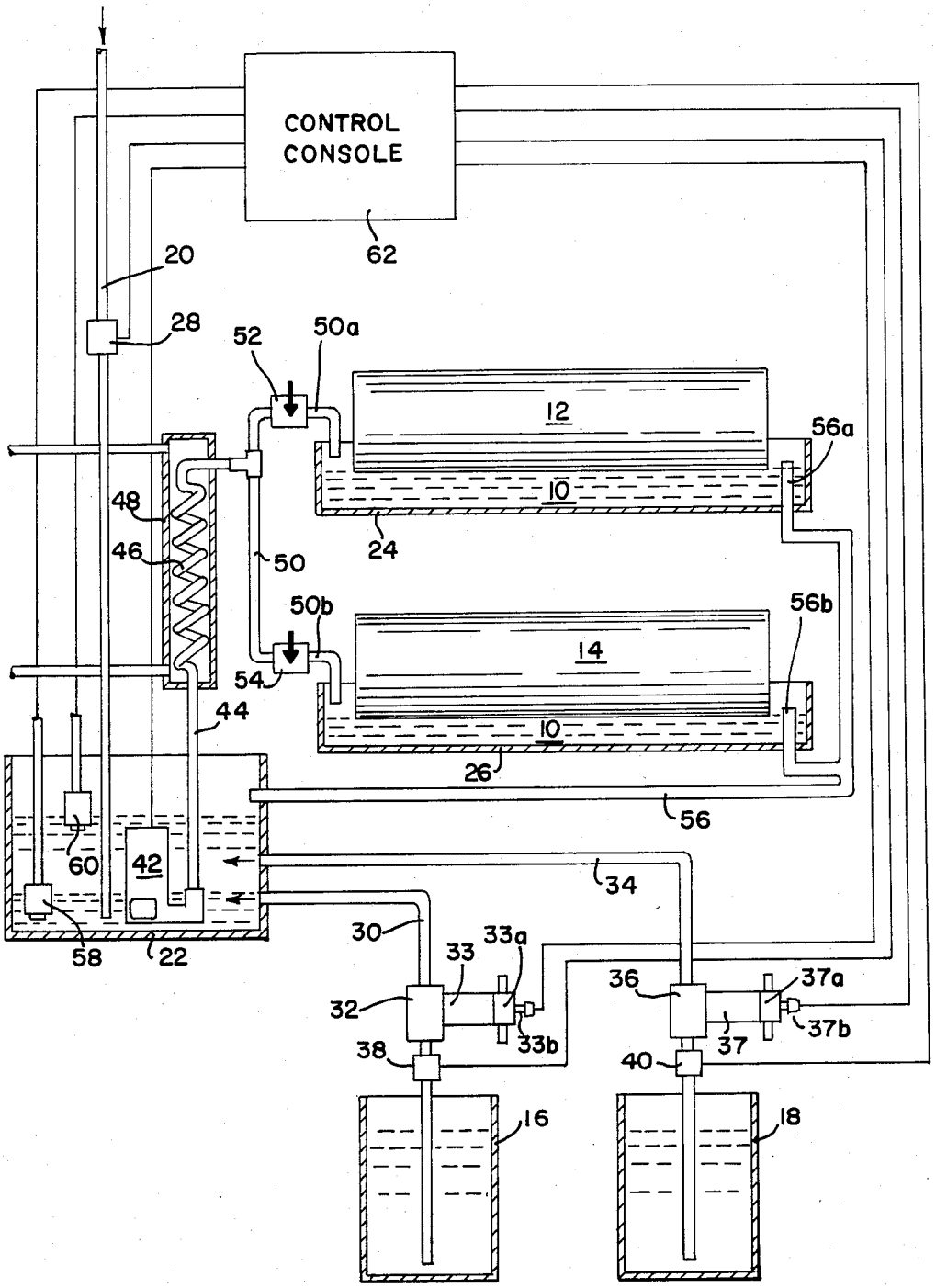
CONTROL CONSOLE
62
20
28
52
50a
12
56a
10
48
46
50
24
50b
56b
14
54
44
10
26
56
60
42
34
58
22
30
33a
33
36
37a
32
37b
33b
37
38
40
16
18

APPARATUS FOR APPLYING SILICONE EMULSION TO A PAPER WEB

BACKGROUND AND SUMMARY OF THE INVENTION

This invention pertains to an apparatus for applying an aqueous silicone emulsion to a paper web as the web is moving through a printing press.

Silicone applicators are used in newspaper, business forms and commercial web operations in order to lubricate the surface of the web for ease of handling and separation of the sheets. The silicone concentrate is mixed with water in a mixing tank and then pumped to a tray from which it is picked up by rollers and applied to the web. Heretofore, the pressman has had to manually mix up a batch of the emulsion in a large mixing tank on the press room floor, and the usual method of delivering the emulsion from the tank on the floor to the elevated roller trays has been by means of a heavy rotary vane pumps. With this type of system, there was little control over the silicone emulsion concentration, and it required the pressman to constantly monitor the silicone reservoir to assure continuous delivery of silicone emulsion to the web.

The present invention is intended to automate the silicone application apparatus permitting the automatic mixing of small quantities of the silicone emulsion at a time so that the concentration of silicone can be controlled and easily altered. The mixing tank is small enough to be located up from the floor of the press room in close proximity to the elevated roller trays. The silicone emulsion is delivered to the mixing tank from supply drums with means for switching from one drum to the other when the drum is empty. The system eliminates the heavy rotary vane pump and filters which were heretofore necessary in order to lift the emulsion from the floor level, and it provides complete control over the application by the pressman.

In accordance with one embodiment of the invention, the silicone applicator comprises at least one silicone concentrate supply tank, a water supply means containing a supply of water and a mixing tank for batch mixing the silicone concentrate with the water to form an aqueous silicone emulsion of the desired concentration. The water supply means may be conveniently a water line controlled by means of a solenoid valve.

The applicator also has a silicone holding tray for holding a supply of silicone emulsion, and roller means rotating at least partially in the holding tray picks up the silicone emulsion from the holding tray and applies it to the paper web. There is a first transfer means for transferring to the mixing tank metered quantities of the silicone concentrate from the supply tank and water from the water supply means. This first transfer means preferably includes a water transfer means such as the aforementioned solenoid valve which controls the transfer of water to the mixing tank in sufficient quantity to fill the mixing tank to a predetermined level. The first transfer means has a silicone transfer means for repeatedly transferring metered or measured charges of silicone concentrate to the mixing tank from the silicone concentrate supply tank.

The applicator also includes an adjustable control means for controlling the amount of silicone concentrate transferred by the first transfer means to the mixing tank so that the concentration of the aqueous silicone emulsion mixed in the mixing tank may be controlled. This adjustable control means preferrably controls the number of measured charges of silicone concentrate delivered to the mixing tank for each filling of the tank by the water transfer means. If desired, there may also be means for adjusting the amount of emulsion in each charge delivered to the mixing tank. There is further included a second transfer means for delivering the mixed silicone emulsion from the mixing tank to the holding tray and it is desired that there also be a means for recirculating the emulsion from the holding tray back to the mixing tank.

BRIEF DESCRIPTION OF THE DRAWING

The single FIGURE is a schematic illustration of the apparatus for applying the controlled concentration of an aqueous silicone emulsion to a paper web.

DETAILED DESCRIPTION OF THE PREFERRED EMBODIMENT

The silicone applicator illustrated schematically in the FIGURE is used in conjunction with a printing press (not shown) to apply an aqueous silicone emulsion 10 to the web (not shown) by means of one or more applicator rollers such as the rollers 12 and 14 schematically illustrated in the figure. In this illustration, the roller 12, for example, may apply the aqueous silicone emulsion to one side of the paper web while the applicator roller 14 applies it to the opposite side of the web.

The silicone concentrate is supplied in large containers, usually 55 gallon drums. In the illustrated embodiment, two of these supply tanks 16 and 18 are illustrated. A water supply means in the form of a standard water pipe 20 supplies water to the system. The silicone concentrate and water are mixed together as a batch in a small mixing tank 22 and the resulting silicone water emulsion is then transferred to the holding trays 24 and 26, the tray 24 holding the silicone emulsion which is picked up by the applicator roller 12 and the tray 26 holding the silicone emulsion which is picked up by the applicator roller 14.

Means is provided for transferring to the mixing tank 22 a predetermined quantity of the silicone concentrate from the supply tanks 16 and 18, and a predetermined quantity of water from the water supply means 20. The first transfer means includes a water trasfer valve 28 in the water supply pipe 20 for controlling the quantity of water transferred to the mixing tank from the water supply pipe. This first transfer means also includes means for transferring the silicone concentrate from each of the supply tanks 16 and 18 in adjustable controlled quantities. Extending between the first supply tank 16 and the mixing tank 22 is a concentrate supply pipe 30. In line with and controlling the concentrate delivered through supply pipe 30 is a metering pump 32. The metering pump may be any kind of piston or diaphragm pump which has a positive displacement so that upon each stroke of the pump a predetermined quantity of fluid is moved through the pipe 30. This pump can be one which is controlled by a counter which counts pulses or pump strokes and permits the pump to operate for a predetermined number of strokes for each batch cycle. The number of strokes per batch cycle can be adjusted so that the quantity of silicone concentrate delivered during each batch cycle can be adjusted. This controls the concentration of the emulsion.

The metering pump 32 can be one which is operated by a reciprocating motor such as an air cylinder 33 having a solenoid-operated air valve 33*a*, with the length of the stroke of the piston being regulated by means of a stop adjustment 33*b* for the stroke of the air cylcinder piston which drives the piston of the positive displacement metering pump 32. In a like manner, the second supply tank 18 has a concentrate supply pipe 34 and a metering pump 36 which is driven by an air cylinder 37 having a solenoid-operated air valve 37*a* and a stop adjustment 37*b* for the air cylinder piston.

It is preferred that there be a switching mechanism for the concentrate supply pipes 30 and 34 which will sense when the associated supply tanks 16 and 18 are empty and effect switching of the pumping operation from the empty supply tank to the full supply tank. In the preferred embodiment, this is accomplished by means of vacuum switches 38 and 40 of well-known construction. So long as the metering pump 32 is pumping liquid silicone concentrate, the switches 38 and 40 will permit pump 32 to operate, the pump 36 will remain off. When the supply tank 16 empties, the metering pump 32 will begin to draw air through the bottom of the pipe 30. This will be sensed by the vacuum switch 38 which will switch off the pump 32 to the first supply tank 16 and switch on the pump 36 to draw the silicone concentrate from the second supply tank 18. The operator can then replace empty tank 16 with a full tank. When the tank 18 empties, the vacuum switch 40 will sense that condition and switch pump 36 off and again turn pump 32 on so that concentrate can be drawn from the now refilled tank 16.

Located within the mixing tank 22 is a submersible mixing pump 42 which pumps the silicone emulsion which has been mixed in the mixing tank 22 through a pipe 44 and through the coils 46 of a heat exchange system 48 to a manifold 50. The manifold has two delivery pipes 50*a* and 50*b* which deliver the mixed silicone emulsion to the holding trays 24 and 26, respectively. An adjustable flow regulator valve 52 in line with the pipe 50*a* controls the delivery of the mixed emulsion through the pipe 50*a* to the holding tray 24. In like manner, an adjustable flow regulator valve 54 in line with the delivery pipe 50*b* controls the delivery of the silicone emulsion through the pipe 50*b* to the holding tank 26. A return pipe 56 having intake ends 56*a* and 56*b* located at the desired liquid levels in holding trays 24 and 26, respectively permits the gravitational return of the silicone emulsion from the holding trays 24 and 26 when the level of the silicone emulsion reaches the level of the intake ends 56*a* and 56*b*. The silicone emulsion flows through the return pipe 56 back into the mixing tank 22.

Means is provided in the mixing tank 22 for sensing the level of the liquid in the tank. For this purpose, a low level sensor 58 and a high level sensor 60 are provided. The entire system is controlled by a control console 62 through well known relays and solid-state electronics, including micro-processors.

The operation of the system is as follows:

When the low liquid sensor 58 senses a low level of liquid in the mixing tank 22, a signal is delivered to the control console 62 which starts the transferring and delivery cycles. A signal from the control console to the water transfer valve 28 turns this valve on, delivering water from the water supply pipe 20 to the mixing tank 22. When the high liquid level sensor 60 senses that the mixing tank 22 has been filled, the control console turns off the water valve 28. At this point, the metering pump 32 is turned on to charge the desired quantity of silicone concentrate into the tank and thereby produce an emulsion of the desired concentration. By adjustment either at the stop adjustment 33*b* or at the console 62, the pressman may either regulate the length of the stroke (strokes) of the metering pump piston or the number of cycles of the metering pump needed to deliver the proper quantity of the silicone concentrate through the concentrate supply pipe 30 to the mixing tank 22. The control console, for example, may count 10 strokes of the metering pump 32 after which the metering pump is shut off. The ten strokes of the metering pump would then constitute the adjustable quantity of silicone concentrate which is delivered to the metering tank. The number of pulses or strokes may be varied by well known pulse counter controls. If during this pumping operation the supply tank 16 should run dry, the vacuum switch 38 will sense this sending a signal back to the control console 62 which in turn will switch off the metering pump 32 and turn on the metering pump 36 completing the desired number of pumping strokes by means of metering pump 36 and concentrate supply pipe 34.

Upon the completion of the delivery of the silicone concentrate to the mixing tank through either supply pipe 30 or supply pipe 34, the submersible pump 42 is turned on by the control console 62 causing the concentrate and water to be mixed in the mixing tank 22 and causing the resulting emulsion to be pumped through the pipe 44, the heat exchanger coils 46 and the delivery pipes 50*a* and 50*b* to the holding trays 24 and 26. The flow rate through the delivery pipes 50*a* and 50*b* is regulated by the flow regulators 52 and 54 with respect to the flow rate through the intake ends 56*a* and 56*b* of the return pipe 56, so that the emulsion level in the trays will remain constant without danger of the emulsion overflowing the trays.

The applicator rollers 12 and 14 are adapted to contact opposite sides of the paper web moving through the printing press. These rollers rotate within the silicone emulsion 10 which has been delivered to and is contained in the holding trays 24 and 26, respectively. This emulsion will be thus picked up by these rollers and transferred to the respective sides of the paper web.

In some cases it is desirable to regulate the temperature at which the silicone emulsion is held and this can be done by means of the heat exchanger 48 containing the coils 46. Water at the desired temperature may be pumped through the heat exchanger 48 in the usual and well known manner. If it desired to cool off the silicone emulsion, cold water can be pumped through the heat exchange system. If it is desired to heat up the silicone emulsion, hot water can be pumped into the heat exchanger 48.

The system illustrated in the FIGURE permits an accurate control of the concentration and temperature of the silicone emulsion being applied to the paper web. In the system, the method employed includes the steps of delivering a quantity of water to a mixing vessel sufficient to fill the vessel to a predetermined level, charging into that vessel an adjustable quantity of silicone concentrate to mix with the water and provide therein a measured quantity of an aqueous silicone emulsion in an adjustable concentration, thereafter pumping the aqueous silicone emulsion from the mixing vessel to a holding tray and transferring the emulsion from the holding tray to the paper web by roller means rotating in contact with both the emulsion and the web.

The apparatus of the present invention eliminates the necessity of having the press operator constantly tend the silicate emulsion applicator and provide a very accurate and close control over the silicone application. The system provides for the automatic switching from one drum when it becomes empty to the next drum which is full and it permits batch mixing of small quantities of the silicone emulsion so that the concentration can be changed upon each batch mixing of the emulsion, permitting fast changes in the concentration of the silicone emulsion to meet the requirements of the coating operation.

The foregoing has been given by way of an example and it will be readily apparant to those skilled in the art that various modifications may be made in the apparatus and method herein described without departing from the spirit and scope of the invention as hereinafter claimed.

What is claimed is:

1. A silicone applicator for applying a controlled concentration of an aqueous silicone emulsion to a paper web as the web is moving through a printing press, said applicator comprising at least one silicone concentrate supply mixing tank, a water supply means for containing a supply of water, a mixing tank for mixing silicone concentrate with water to form an aqueous silicone emulsion of the desired concentration, a silicone holding tray for holding a supply of silicone emulsion, roller means for picking up the silicone emulsion from said holding tray and applying it to a paper web, water transfer means for transferring water from said water supply means to said mixing tank in sufficient quantity to fill said mixing tank to a predetermined level, and silicone transfer means for repetitively transferring measured charges of silicone concentrate to said mixing tank from said silicone concentrate supply tank, said water transfer means including low level liquid sensing means for sensing when the level of liquid in said mixing tank is below a predetermined low level, high level liquid sensing means for sensing when the level of liquid in said mixing tank is above a predetermined high level, and valve means responsive to said first and second sensing means for opening to charge water into said mixing tank when said liquid level reaches said low level and for closing to discontinue the charging of water when said liquid level reaches said high level, adjustable control means for controlling the amount of silicone concentrate transferred by said first transfer means to said mixing tank by controlling the number of measured charges of silicone concentrate delivered to said mixing tank for each filling of said mixing tank by said water transfer means, whereby the concentration of the aqueous silicone emulsion mixed in said mixing tank may be controlled, and second transfer means for delivering the controlled concentration of the mixed silicone emulsion from said mixing tank to said holding tray.

2. The apparatus of claim 1 wherein there are at least two silicone concentrate supply tanks and said silicone transfer means includes a metering pump for each supply tank and tank switch means for deenergizing the associated metering pump when one supply tank is empty and for simultaneously energizing the associated metering pump for the next supply tank.

3. The applicator of claim 1 and further including recirculation means for recirculating the mixed emulsion from said silicone holding tray back to said mixing tank.

4. The applicator of claim 1 wherein said second transfer means includes temperature regulation means for regulating the temperature of the mixed silicone emulsion being delivered from said mixing tank to said holding tray.

5. The applicator of claim 3 wherein said recirculation means includes an intake within said holding tray located at the desired liquid level of silicone emulsion, whereby the silicone emulsion will enter said recirculation means for return to said mixing tank only when the level of emulsion in the tray rises above the desired liquid level.

* * * * *